United States Patent [19]

Kodama et al.

[11] Patent Number: 4,457,270

[45] Date of Patent: Jul. 3, 1984

[54] HYDRAULIC LIFTER

[75] Inventors: Hisashi Kodama, Nagoya; Katsujiro Sato, Toyota; Tetsuomi Tamura; Tooru Hamamoto, both of Okazaki; Kazuharu Yamada, Toyota, all of Japan

[73] Assignees: Aisin Seiki Kabushiki Kaisha; Toyota Jidosha, both of Japan

[21] Appl. No.: 483,705

[22] Filed: Apr. 11, 1983

[30] Foreign Application Priority Data

Apr. 12, 1982 [JP] Japan ..... 57-53394[U]

[51] Int. Cl.[3] ..... F01L 1/24

[52] U.S. Cl. ..... 123/90.58; 123/90.55

[58] Field of Search ..... 123/90.48, 90.52, 90.53, 123/90.55, 90.58; 74/569

[56] References Cited

U.S. PATENT DOCUMENTS

| | | | |
|---|---|---|---|
| 2,833,257 | 5/1958 | Lengnick | 123/90.58 |
| 3,521,608 | 7/1970 | Scheibe | 123/90.58 |
| 4,054,109 | 10/1977 | Herrin et al. | 123/90.55 |
| 4,098,240 | 7/1978 | Abell | 123/90.55 |
| 4,191,142 | 3/1980 | Kodama | 123/90.58 |
| 4,368,699 | 1/1983 | Kodama | 123/90.58 |
| 4,385,599 | 5/1983 | Hori et al. | 123/90.58 |

*Primary Examiner*—Ira S. Lazarus
*Assistant Examiner*—R. S. Bailey
*Attorney, Agent, or Firm*—Finnegan, Henderson, Farabow, Garrett & Dunner

[57] ABSTRACT

An oil-containing hydraulic lifter for lash adjustment comprising relatively movable cylinder and plunger members defining a pressure chamber between their closed ends and a reservoir chamber within the plunger. Means are provided for rapid, one-way flow of the oil from the reservoir to the pressure chamber during outward movement of the plunger and for slow, one-way flow from the pressure to the reservoir chamber during inward movement of the plunger. A flexible, bag-shaped diaphragm extending into the reservoir chamber has its open, upper end sealed liquid tightly to the inner wall of the reservoir for sealing in the oil while expanding and collapsing with reciprocation of the plunger. The reservoir chamber has an increased diameter at that part where the diaphragm undergoes most of its expansion and collapse, thereby spacing the inner wall of the reservoir chamber from the diaphragm by a distance great enough to allow full expansion of the diaphragm in the expanding and collapsing operation thereof. The effect is to greatly increase the volumetric change exhibited by the oil within the reservoir chamber during the reciprocation of the plunger, thereby enhancing lash adjusting performance.

1 Claim, 2 Drawing Figures

HYDRAULIC LIFTER

BACKGROUND OF THE INVENTION

1. Field of the Invention

This invention relates to a sealed hydraulic lifter and, more particularly, to a hydraulic lifter suitable for use as a lash adjuster in the valve train, or valve drive mechanism, of an internal combustion engine.

2. Description of the Prior Art

A hydraulic lifter for the abovementioned application includes a cylinder member and a hollow, cylindrically shaped plunger member nested slidably within the cylinder member for telescoping motion. The cylinder and plunger members define a pressure chamber between their closed ends. The plunger member is provided internally with a reservoir chamber for receiving leakage oil from the pressure chamber through a clearance space which exists between the telescoping cylinder and plunger members, and for supplying replenishment oil from the reservoir to the pressure chamber through a check valve. Thus the hydraulic lifter is adapted to allow prompt expansion of the pressure chamber volume and to permit a reduction in said volume, though offering resistance to the volume reduction in the latter case so that such reduction takes place at a slow rate. The hydraulic lifter utilizes these characteristics for quickly taking up play in the engine valve train, and thus functions as a lash adjuster for driving the valve train while resisting the force applied by a valve return spring.

The reservoir chamber in the plunger member typically is provided with a bag-shaped diaphragm the upper end of which is held in pressured contact with the inner wall of the reservoir chamber to effect a liquid-tight seal. The interior of the reservoir chamber is filled with a hydraulic fluid, namely oil, with the diaphragm serving as a flexible barrier between the oil in surface contact with one side thereof and the atmosphere on the other side. The diaphragm thus is free to expand and contract as the quantity of oil within the reservoir chamber changes with the telescoping movement of the plunger member.

Maximizing the lash adjustment capability of the hydraulic lifter is essential to obtain a lash adjuster having a high degree of reliability. Thus, the greater the change in the oil volume interiorly of the lifter reservoir, the better the lash adjusting performance, assuring excellent reliability even if some oil is lost through leakage. A requirement for obtaining such a large change in oil volume is to shape the inner wall surface of the reservoir chamber so as to allow a large change in the shape of the diaphragm as the diaphragm expands and collapses during operation of the hydraulic lifter.

The reservoir chamber in the conventional hydraulic lifter, however, has a cylindrically shaped inner wall over its entire length and is therefore readily contacted by the outer side of the diaphragm as the diaphragm expands in adapting itself to a change in chamber volume. Such contact between the diaphragm and the closely spaced reservoir chamber wall makes it impossible to achieve a large change in diaphragm shape, thereby placing a limitation upon the change in volume that can be brought to bear upon the oil within the reservoir. This prevents the attainment of a large lash adjustment capability and, hence, results in a lash adjuster having less than the desired reliability.

SUMMARY OF THE INVENTION

The object of the present invention is to provide a hydraulic lifter which eliminates the aforementioned disadvantage of the prior art by means of a plunger member having an interiorly provided reservoir chamber of an increased diameter at that part of the reservoir chamber where the diaphragm undergoes most of its expansion and contraction. The portion of increased diameter is achieved by thinning the side wall of the plunger member from the inner side thereof, thereby spacing the inner wall of the reservoir chamber from the diaphragm by a distance great enough to allow full expansion of the diaphragm in the expanding and collapsing operation thereof. The effect is to greatly increase the volumetric change exhibited by the oil within the reservoir chamber during the telescoping action of the cylinder and plunger members, thereby enhancing the lash adjusting performance of the hydraulic lifter.

Other features and advantages of the invention will be apparent from the following description taken in conjunction with the accompanying drawings.

DESCRIPTION OF THE PREFERRED EMBODIMENT

Figure 1:
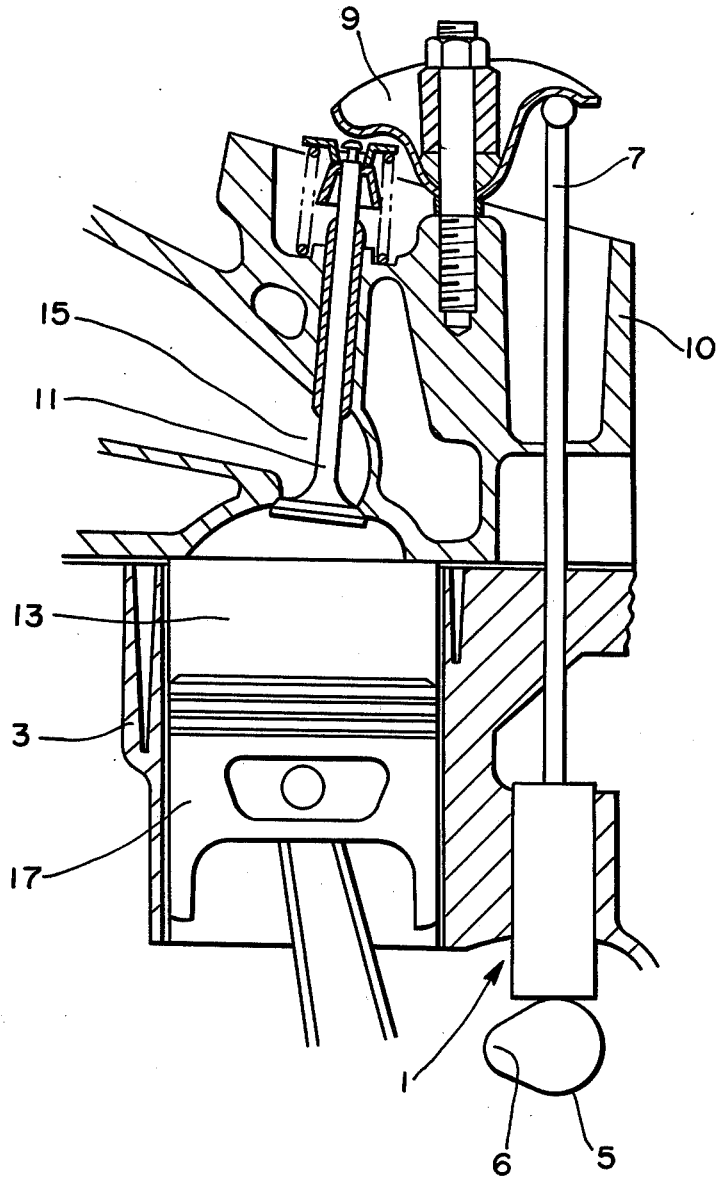
FIG. 1 is a longitudinal view partly in section showing a valve train in an internal combustion engine having the hydraulic lifter of the present invention installed between a valve operating cam and push rod.

The hydraulic lifter, designated generally at numeral 1, is arranged for reciprocation slidably in an engine block 3 by an underlying cam 5 having a nose 6. A push rod 7 has a lower end engaging with a hemispherical recess formed in a plunger cap, described below, and an upper end in abutting contact with one end of a rocker arm 9 mounted on the engine cylinder head 10 so that the other end thereof may engage a poppet valve 11. Thrust is transmitted by the push rod 7 to the rocker arm 9 to depress the poppet valve 11, thereby opening a combustion chamber 13 to a suction/exhaust port 15. Thus the cam 5, hydraulic lifter 1, push rod 7 and rocker arm 9 constitute a valve train. Numeral 17 denotes a piston reciprocated within the engine block 3.

Figure 2:
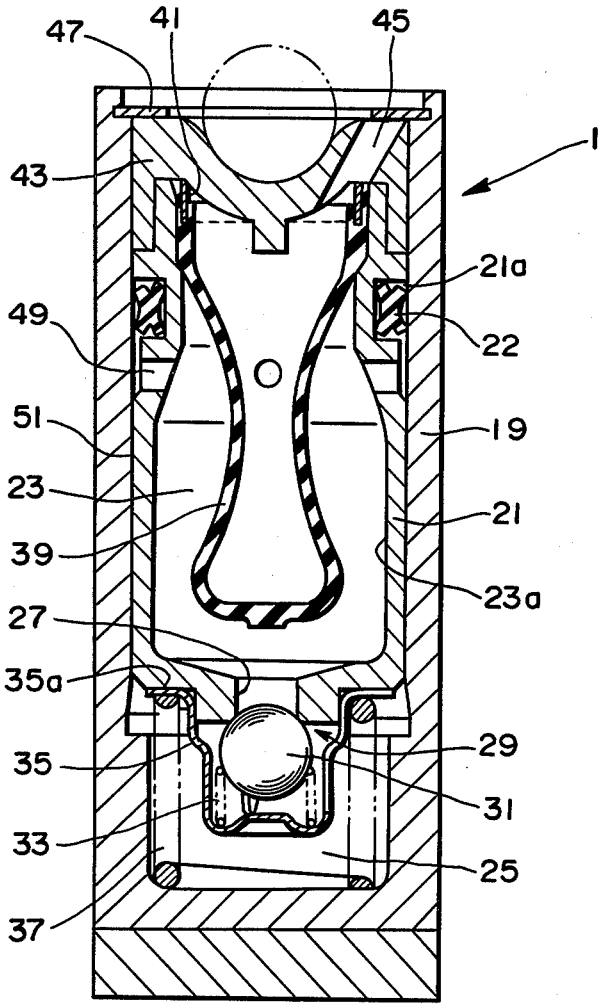
FIG. 2 is an enlarged longitudinal sectional view of the hydraulic lifter shown in FIG. 1.

As shown in FIG. 2, the hydraulic lifter 1 comprises an outer cylinder member 19 and an inner cylinder plunger member 21 nested snugly within the cylinder member for sliding motion. An annular groove **21*a* is formed in the outer wall of the plunger member 21 and receives an annular sealing member 22 for effecting a seal between the plunger member 21 and inner wall of the cylinder member 19 to prevent loss of oil. The plunger member 21 is a hollow body, having a reservoir chamber 23 interiorly thereof sealed by means described below. A pressure chamber 25 is defined between the closed ends of the cylinder member 19 and plunger member 21. A passage 27 extends through the closed end of the plunger member 21 to communicate the reservoir chamber 23 with the pressure chamber 25 via a check valve 29. The latter comprises a ball 31, a return spring 33 for loosely retaining the ball 31 against the lower end of the passage 27, the rim of the passage opening at said end serving as a valve seat, and a cage 35 having a flange 35*a* held in contact with the closed end of the plunger member 21 by a spring 37 to retain the return spring 33. The spring 37, of considerable size, is interposed and compressed between the closed end of the cylinder member 19, which defines the floor of the pressure chamber 25, and the flange portion 35***a* of the cage 35. Thus the spring 37 holds the cage 35 in pressured contact with the closed end of the plunger member 21 and urges the plunger member 21 outwardly of the cylinder member 19.

A bag-shaped diaphragm 39 has the outer peripheral surface of its open end kept in liquid-tight pressurized contact with the inner wall of the plunger member 21 by means of a ring 41, thereby serving to seal oil within the reservoir chamber 23. A cap 43 is fitted snugly on the upper, open end of the plunger member 21 and has a substantially hemispherical recess serving as a seat for the lower end of the push rod 7 shown in FIG. 1, as well as a vent opening 45 communicating the space interiorly of the diaphragm 39 with the atmosphere. A snap ring 47 is fit in an annular groove formed in the cylinder member 19 above the cap 43 and functions as a stopper which determines the outermost position of the plunger member 21. The side walls of the plunger member 21 below the sealing member 22 are penetrated by ports 49 communicating the interior of the reservoir chamber 23 with a side clearance space 51 which exists between the sidably fitted external side surfaces of the plunger member 21 and the internal side surfaces of the cylinder member 19 below the ports 49.

According to the hydraulic lifter having the above-described construction, oil which leaks into the clearance space 51 from the pressure chamber 25 is returned to the reservoir chamber 23 through the ports 49 in slow-moving fashion. Conversely, the oil which collects in the reservoir chamber 23 is supplied as replenishment oil to the pressure chamber 25 through the passage 27 past the open check valve 29 in rapid fashion. The effect is to allow a prompt increase in the volume of the oil within the pressure chamber 25 when the check valve 29 is open, and to allow but a slow decrease in the presure chamber oil volume when the check valve 29 is closed. It is this property that the hydraulic lifter 1 utilizes to function as a lash adjuster in the valve train shown in FIG. 1, as will now be described in greater detail.

Lash adjustment in the valve train of FIG. 1 is initiated by the action of the spring 37 which elongates in response to play or clearance in the valve train to urge the plunger member 21 upwardly or outwardly against the push rod 7, thereby taking up the valve play. During this period the check valve 29 is open, permitting oil to flow rapidly from the reservoir chamber 23 into the pressure chamber 25 through the passage 27. With each lift stroke of the cam 5, the nose 6 of the cam thrusts the hydraulic lifter 1 upwardly through the engine block 3, whereby the check valve 29 is closed against reverse flow through the passage 27 by inward movement of the plunger member 21 so that pressure builds in the pressure chamber 25, with the clearance space 51 offering resistance to oil flow therethrough so that leakage of oil from the pressure chamber 25 back into the reservoir chamber 23 through the ports 49 takes place at a slow rate. Thus the thrust exerted by the cam 5 is transmitted to the valve train, terminating in the poppet valve 11, through the intermediary of the oil in the pressure chamber 25 of the hydraulic lifter 1.

It will be apparent from the foregoing description that the oil within the reservoir chamber 23 undergoes a volumetric change whenever the lash adjustment is performed, and that the diaphragm 39, forming a flexible barrier between the oil and atmospheric air, will change in shape by expanding and collapsing within the reservoir chamber 23 in response to the change in oil volume. A requisite for improving the lash adjusting performance of the hydraulic lifter is that the amount of volumetric change of the oil internally of the reservoir chamber 23 be increased. This entails maximizing the amount of deformation of the diaphragm 39. To this end, according to a feature of the present invention, the reservoir chamber 23 is so shaped as to allow a large degree of change in the shape of the diaphragm. As shown in FIG. 2, this is achieved by reducing the side wall thickness of the plunger member 21 from the inner side thereof at the portion below the seal 22 so that the reservoir chamber 23 has a portion of increased diameter, indicated at numeral 23*a*, relative to the portion thereof extending from the seal 22 upward. Thus the volume of the reservoir chamber 23 is enlarged by an amount corresponding to the increase in the diameter thereof below the seal 22. Since the portion 23*a* of increased diameter surrounds that part of the diaphragm 39 which sustains most of the deformation that occurs during operation of the hydraulic lifter, the effect is to permit greater freedom for expansion of the diaphragm 39 and, hence, a greater variation in the overall shape thereof. This in turn enlarges the amount of volumetric change that can take place internally of the reservoir chamber 23, thereby lengthening the stroke of the plunger member 21 to enhance the lash adjusting performance of the hydraulic lifter. Note that the "side wall thickness" mentioned above refers to the distance between the cylindrical outer wall surface of the plunger member 21 where it slides against the inner wall surface of the cylinder member 19, and the inner wall surface of the reservoir chamber 23. This distance is less below the seal 22 and hence represents a reduced wall thickness. Note that whereas the side wall of the plunger member 21 must have at least a minimum thickness at and above the seal 22 in order for the seal member 22 and cap 43 to be fit and retained properly, resulting in the constricted portion of relatively small diameter at the upper portion of the reservoir chamber 23, the wall of the plunger below the seal 22 is capable of being reduced in thickness to a greater extent than that at and above, providing the increased diameter portion 23*a* without problem and affording the concommitant effects described above.

As many apparently widely different embodiments of the present invention may be made without departing from the spirit and scope thereof, it is to be understood that the invention is not limited to the specific embodiments thereof except as defined in the appended claims.

What we claim is:

1. A self-contained hydraulic lifter comprising:

a cylinder member closed at one end;

a hollow, cylindrical plunger member slidably nested in the cylinder member;

said cylinder and plunger members defining a pressure chamber between one end of the plunger member and the closed end of the cylinder member and a reservoir chamber interiorly of the plunger member, said one end of the plunger member having a passage for flow of a hydraulic fluid;

a check valve for said passage openable toward the pressure chamber for allowing a relatively rapid rate of hydraulic fluid flow from the reservoir chamber to the pressure chamber during movement of the plunger member outwardly of the cylinder member;

said plunger member having a side clearance in the cylinder member and a port connecting the side clearance with the reservoir chamber for allowing a relatively slow rate of hydraulic fluid flow from the pressure chamber to the reservoir chamber during movement of the plunger member inwardly of the cylinder member;

an annular sealing member disposed in the side clearance above said port for sealing off the side clearance from the atmosphere;

said reservoir chamber having a portion of a first diameter at the location of the sealing member, and a portion of a second diameter between the location of said sealing member and said one end of the plunger member, said second diameter being larger than said first diameter; and a flexible, bag-shaped diaphragm in the reservoir chamber having an open, upper end the exterior surface of which is in liquid-tight pressured contact with an inner wall of the reservoir chamber above the sealing member for sealing hydraulic fluid in the reservoir chamber, one side of said diaphragm inwardly of the reservoir chamber being in surface contact with hydraulic fluid, the other side of said diaphragm contacting the atmosphere.

* * * * *